US007464505B2

(12) United States Patent
Grenier

(10) Patent No.: US 7,464,505 B2
(45) Date of Patent: Dec. 16, 2008

(54) STAIRCASE FINISHING PLATE ARRANGEMENT

(76) Inventor: Gilles Grenier, 516, Des Cèdres, St-Elzéar, QBC (CA) G0S 2J0

( * ) Notice: Subject to any disclaimer, the term of this patent is extended or adjusted under 35 U.S.C. 154(b) by 330 days.

(21) Appl. No.: 11/134,439

(22) Filed: May 23, 2005

(65) Prior Publication Data

US 2006/0260224 A1 Nov. 23, 2006

(51) Int. Cl.
*E04F 11/16* (2006.01)

(52) U.S. Cl. ..... 52/179; 52/188

(58) Field of Classification Search ..... 52/179, 52/188, 182, 190, 716.1, 590.2, 591.2; 24/DIG. 53, 24/DIG. 54, 580.1, 590.1; 411/469, 477, 411/457, 921; 403/286, 294, 283; 312/265.5, 312/235.1, 278

See application file for complete search history.

(56) References Cited

U.S. PATENT DOCUMENTS

| | | | | | |
|---|---|---|---|---|---|
| 151,865 | A * | 6/1874 | Ely | 24/580.1 |
| 1,622,739 | A * | 3/1927 | Rosenblum et al. | 52/179 |
| 1,792,792 | A * | 2/1931 | Woodbridge | 52/179 |
| 2,205,044 | A * | 6/1940 | Moore | 52/179 |
| 2,297,353 | A * | 9/1942 | Goss et al. | 403/345 |
| 2,787,036 | A * | 4/1957 | Mermer | 52/179 |
| 2,827,675 | A * | 3/1958 | Nelson | 52/179 |
| 3,287,867 | A * | 11/1966 | Aton | 52/179 |
| 4,783,939 | A * | 11/1988 | Bergmann et al. | 52/188 |
| 4,840,824 | A * | 6/1989 | Davis | 428/67 |
| 5,117,603 | A * | 6/1992 | Weintraub | 52/390 |
| 5,806,253 | A * | 9/1998 | Nelson | 52/179 |
| 6,067,758 | A * | 5/2000 | Zenkner | 52/182 |
| 6,173,540 | B1 * | 1/2001 | Spivey | 52/191 |
| 6,385,936 | B1 * | 5/2002 | Schneider | 52/589.1 |
| 6,397,529 | B1 * | 6/2002 | Grenier | 52/182 |
| 6,860,071 | B2 * | 3/2005 | Weaber et al. | 52/179 |
| 2004/0234331 | A1 * | 11/2004 | Fenton | 403/286 |

FOREIGN PATENT DOCUMENTS

DE 4225100 A1 * 9/1993

* cited by examiner

*Primary Examiner*—Robert J Canfield
*Assistant Examiner*—Christine T Cajilig
(74) *Attorney, Agent, or Firm*—Equinox Protection; Frank Bonsang

(57) ABSTRACT

A staircase finishing arrangement includes a tread portion presenting a finishing surface layer, a nosing extending across substantially the whole length of the tread portion with a supporting layer affixed to the underside of the surface layer and mortised into the nosing, in the front and/or free side edges of the tread. Mechanical securement members are provided for interengagement as between the nosing and the subjacent riser, and are pivotally mounted such that upon interengagement limited adjustment may be achieved to secure the arrangement in proper transverse locational relationship with the stair.

10 Claims, 3 Drawing Sheets

STAIRCASE FINISHING PLATE ARRANGEMENT

FIELD OF THE INVENTION

The present invention concerns a staircase finishing plate arrangement for installation on a non-finished tread or use as a replacement for a worn tread.

BACKGROUND OF THE INVENTION

It is well known in the art to provide a finishing capping for an unfinished tread, as a replacement of a removed staircase carpet or as a repair element in the replacement of a worn-out tread. An example of such a capping is described in U.S. Pat. No. 4,783,939 and includes a nosing at one end of a capping plate with an insert bonded to the underside of the capping plate. A further example is shown in U.S. Pat. No. 6,067,758 in which a stair construction element for renovation of a worn tread includes a tread portion provided with a nosing at a front margin thereof. My earlier U.S. Pat. No. 6,397,529 discloses a tread finishing plate comprising a top exposed layer of hardwood with a thin internal layer of a veneer bonded or laminated to the underside of the top layer, a nosing being provided at the front margin of the laminate. The prior art proposals suffer from the disadvantage that the facing layer tends to be of relatively thin gauge when compared to the thickness of a conventional tread and accordingly is weaker in strength than the nosing which is of stouter dimension. The result is that during normal use of the staircase the nosing tends to shear off with concomitant wastage of time, materials and the unpleasantness of the situation. A further disadvantage of these proposals is that it is seldom possible to obtain a proper and consistent abutment with the subjacent vertical riser. A less than satisfactory result is achieved.

Accordingly, there is a need for an improved staircase finishing plate arrangement.

SUMMARY OF THE INVENTION

It is therefore a general object of the present invention to provide an improved staircase finishing plate arrangement.

An advantage of the present invention is that the staircase finishing plate arrangement is of greater integrity than conventional finishing plates and provides a more rigid and thus stable configuration for application either to a non-finished or worn tread.

Another advantage of the present invention is that the nosing of the staircase finishing plate arrangement is stronger and less prone to damage or breakage.

Yet another advantage of the present invention is that the staircase finishing plate arrangement provides for a more consistent construction enabling continuous or substantially continuous abutment and/or securing of the nosing with the subjacent riser or stair stringer (or cover thereof) on the side of the tread.

Another advantage of the present invention is that the staircase finishing plate arrangement is provided with a securement means to facilitate final transverse alignment adjustment as between the plate and the supporting tread and/or to better support the plate thereon.

According to an aspect of the present invention, there is provided a staircase finishing plate arrangement comprising a tread portion presenting a finishing surface layer, a nosing extending across substantially the whole length of the tread portion, a supporting layer affixed to the underside of the surface layer and mortised into the nosing, and mechanical securement means provided between the nosing and an underlying tread and riser and being oriented generally parallel to a plane of said tread portion to allow the plate arrangement to slidably secure to the underlying tread and riser in a direction generally parallel to said plane, the mechanical securement means being substantially hidden when the plate arrangement is secured to the underlying tread and riser.

Further nosings may be provided on the tread portion when it has free edges in addition to the principal nosing that extends across the length of the tread; in this instance the supporting layer is mortised into the respective nosing as prescribed.

The finishing surface layer of the tread portion may be unitary or in the alternative may comprise a plurality of elements arrayed and secured sequentially one to the other to provide a unitary surface layer, the nosing being part of one of the elements.

Preferably in order to afford greater integrity to the finishing plate arrangement and to provide resistance to fracture of the nosing from the tread portion, the support layer is of a greater thickness than the surface layer. Typically, the support layer may be ¼ inch compared to ⅛ inch for the surface layer.

The mortising of the supporting layer into the nosing may involve the tapering of the fore edge of that layer to provide a feather-edge or tongue for a substantially tight engagement within a groove of corresponding or substantially corresponding taper provided in the nosing. The support layer is bonded to the underside of the surface layer fully at their interengaging faces including the mortise.

Securement means may be provided in the form of fixtures freely pivotally mounted on a corresponding underlying tread about an axis generally perpendicular to the tread for penetrating and locating the tread portion in place in the area of the nosing. The fixtures may comprise sector-shaped sharpened sprig-like fasteners suitably securable by for example nails within recesses in the top horizontal surface of the non-finished or worn tread. The sharpened ends of the sprig-like fasteners may be bevelled on their undersides such as in use to provide a wedging action to force the nosing of the finishing plate to abut against an underlying tread upon insertion. The recesses are dimensioned in such manner as to limit the degree of pivot and thus afford a control on the extent of lateral adjustment possible as between the tread portion and the underlying tread.

In the alternative the securement means may be provided by means of a plurality of rivets substantially used as a nail and predisposed within a vertical wall of the nosing that interfaces with the subjacent vertical riser.

It will be understood that the tread portion of the present invention is in use bonded to the underlying non-finished tread or worn tread as the case may be.

Another aspect of the invention comprises a staircase including at least one staircase finishing plate arrangement in accordance with the first aspect of the invention.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein:

FIG. 3 is a partially sectioned enlarged perspective view of the embodiment of FIG. 1*a.

DETAILED DESCRIPTION OF THE PREFERRED EMBODIMENTS

With reference to the annexed drawings the preferred embodiments of the present invention will be herein described for indicative purpose and by no means as of limitation.

Figure 1:
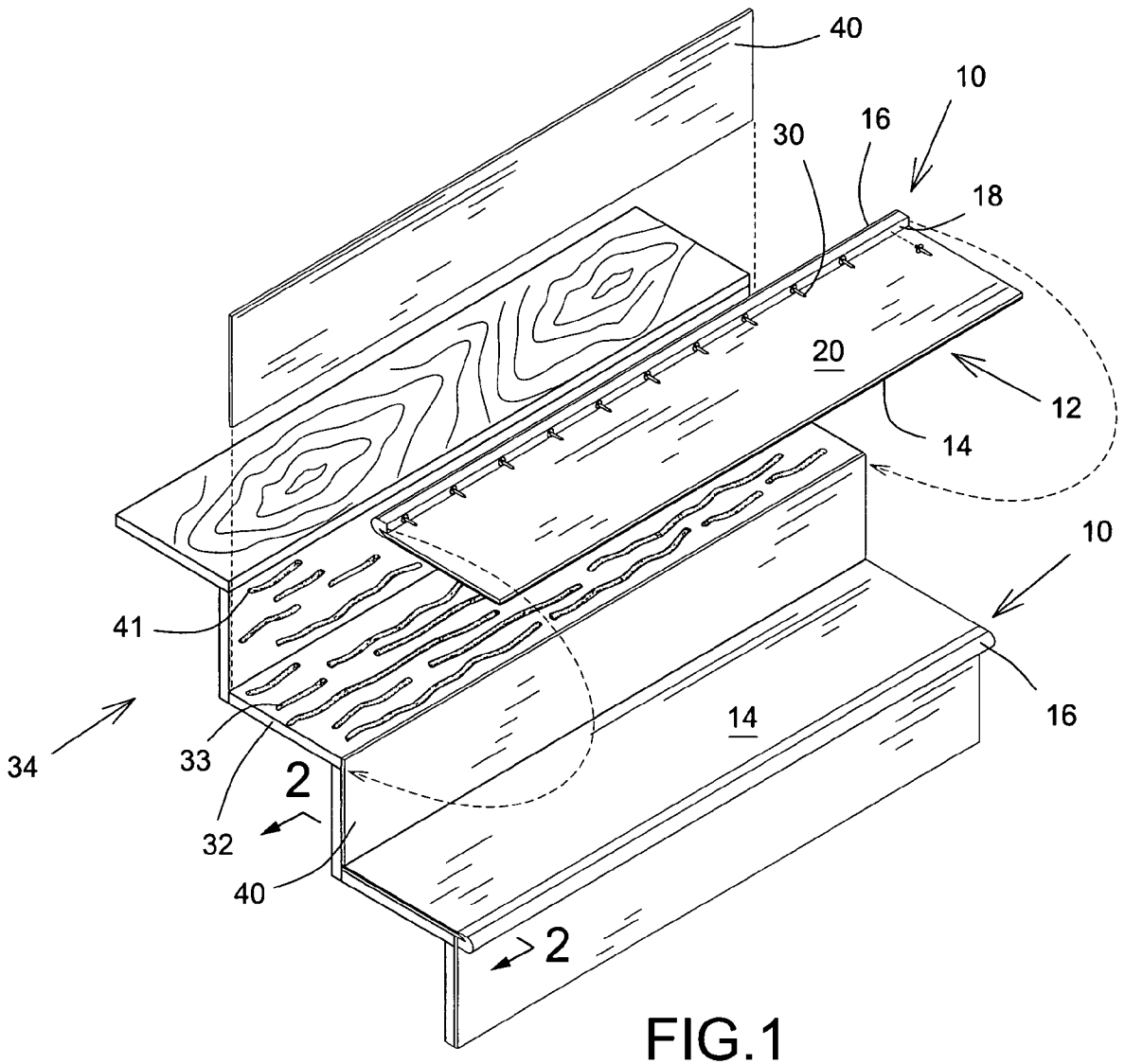
FIG. 1 is a top perspective view of a staircase finishing plate arrangement in accordance with an embodiment of the present invention, showing.
Figure 2:
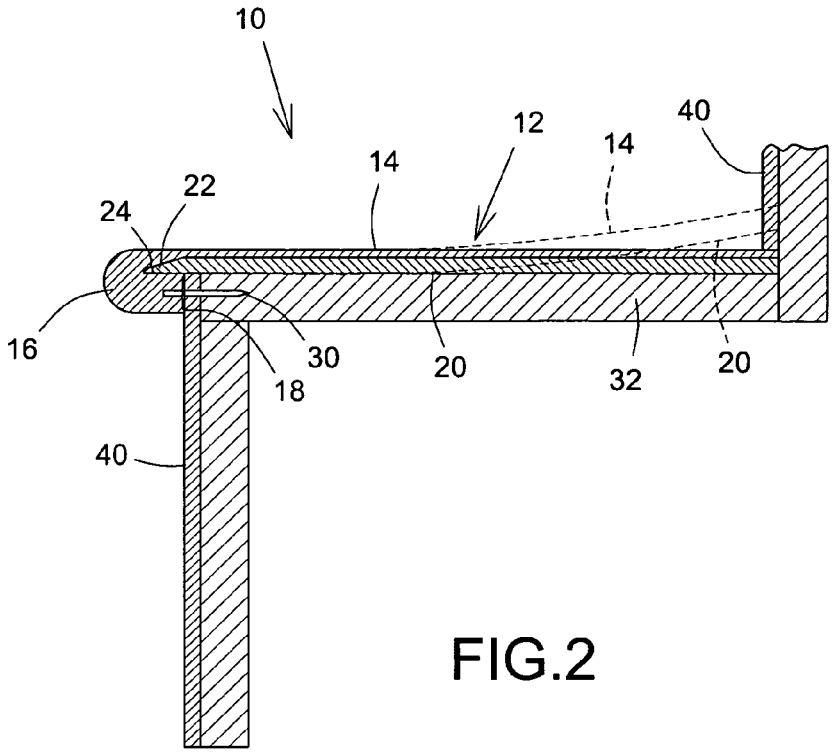
FIG. 2 is an enlarged section view taken along line 2-2 of FIG. 1.

Referring first to FIGS. 1 and 2, there is shown a staircase finishing plate arrangement 10 comprising a tread portion 12 presenting an upper surface layer 14 with a nosing 16 extending along the full length of the plate (across the staircase), the nosing having a vertical abutment wall 18.

A support layer 20 is provided beneath the surface layer 14 and is bonded to the underside thereof. The support layer 20 has a feathered-edge 22 mortised into a correspondingly tapered groove 24 formed in the nosing 16 as shown, thus affording a positive, stable and substantially tight interengagement of the two layers and the nosing to provide integrity and a degree of rigidity. Typically the thickness of the support layer may be about ¼ inch with that of the surface layer being about ⅛ inch, for a total of about ⅜ inch which is within the typically accepted step high variation of a staircase under most building codes. With such a dimensional interrelationship the stiffness achieved prevents or assists in preventing fracture of the nosing from the tread portion. The bonding of the two layers extends over the full interface therebetween including the mortise.

In FIG. 1 the nosing 16 has predisposed within the vertical wall 18 thereof at least one rivet 30, typically a series of nail-type or the like rivets 30, typically forming a mechanical securement means, in a generally equally spaced relationship relative to one another, which for application in situ, upon appropriate impact on the nosing will penetrate and fix the finishing plate to the underlying tread 32 of the staircase 34 and to a subjacent replacement riser 40. Each nail-type rivet 30 is substantially used as a double nail instead of the conventional rivet fastener, as shown in FIG. 1 and more specifically in FIG. 2, where a first side of the rivet 30 is typically first inserted into, or predisposed within, the wall 18 (as illustrated by right end most rivet of FIG. 1) and then inserted into the underlying tread 32 and subjacent replacement riser 40. The arrowed lines in FIG. 1 indicate the manner and orientation of application. The tread portion 12 is bonded as is diagrammatically shown at 33 to the tread 32 thus providing a firm and secure fixing. The stiffness of the nosing 16 with the reinforcement of the support layer 20 results in a greater consistency of abutment as between its vertical wall 18 with the subjacent riser 40 which is preferably pre-installed on the staircase 34 as shown again by the use of bonding as at 41. It has been found in practice that the finishing plate 10 may, prior to installation, have a concave shape especially in The front to back direction and that once installation has been effected the rear end adjacent the riser of the stair tends to bow as shown in FIG. 2 in dotted outline. In order to overcome this bowing and indeed to achieve a tighter fit of the tread portion 12, the superjacent riser is emplaced following installation of the tread portion such that it abuts and forces downwardly the bowed rear end of the tread portion. There is thus provided a positive placement of the rear end of the tread portion 12 in the absence of bowing in that firm bonding as between the tread portion and the underlying tread is duly effected.

Figure 1A:
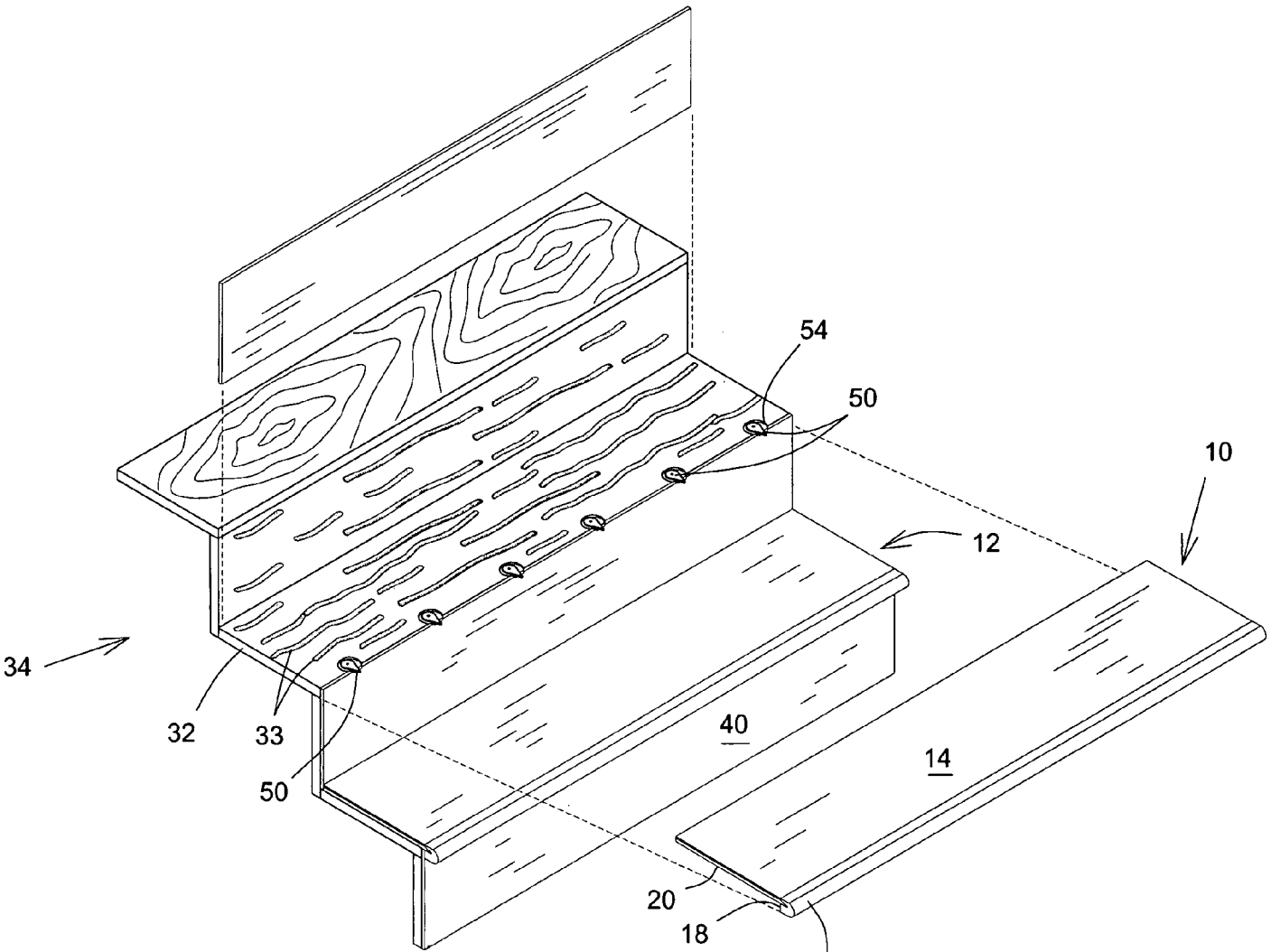
FIG. 1*a* is a top perspective view similar to FIG. 1, showing another embodiment of a staircase finishing plate arrangement.
Figure 3:
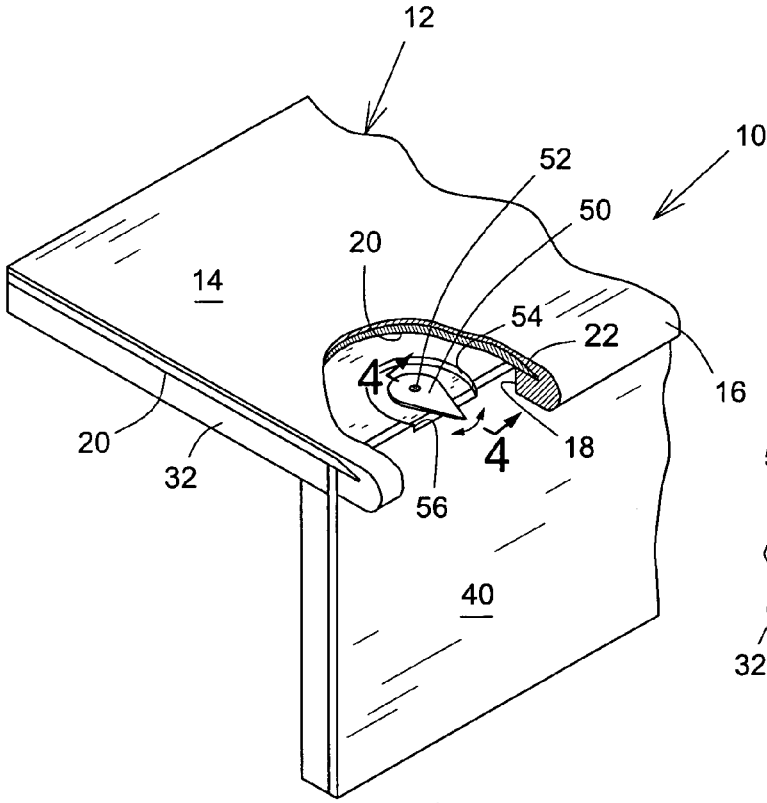
Figure 4:
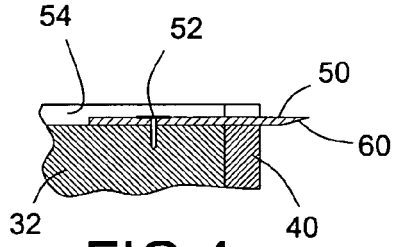
* and FIG. 4 is an enlarged section view taken along line 4-4 of FIG. 3.

Referring now to FIGS. 1*a* and 3 there is illustrated an alternative form of mechanical fixing as between the plate and the existing stair tread 32 of the staircase 34, the fixing taking the form of sector-shaped sharpened sprig-like fasteners 50 for pivotal mounting as at 52 in recesses 54 pre-cut in the top marginal edge of the existing tread 32. The arc of possible movement of each fastener 50 laterally of the tread is determined by the width of the open mouth 56 of each recess 54. The sharpened ends of the fasteners are bevelled as at 60 (FIG. 4) in downward fashion such as to afford a wedging action during penetration of the nosing.

For application of the plate to the existing tread 32 of the staircase similar steps are taken as for the plate of FIG. 1. In this instance, however, the fasteners 50 penetrate the abutment wall 18 of the nosing 16 which abuts the subjacent riser 40 thus providing a stable and secure connection enhanced by the bevelled ends 60 which wedge downwardly to bring the nosing into a firm fixing in relation to the riser. As with the first embodiment of the plate, the tread portion of the plate arrangement is bonded to the existing tread. By virtue of the pivotable fasteners 50 a degree of lateral movement is possible to afford final transverse adjustment of the plate, as typically required for treads of a rectangular form of staircase with a lateral closing wall on one side and the top two triangular treads of a 90 degree turn in a turning staircase.

It will be understood, as foreshadowed supra that the tread portion may be unitary or may comprise a number of separate elements suitably connected one to the other to present the upper surface as described.

It will also be appreciated that whilst the plate arrangement has been illustrated as being applicable to a staircase of rectangular form with open sides, it may equally be applied to a rectangular form staircase with one or two lateral walls, a turning staircase or a spiral form of staircase where the treads are of triangular shape.

It is to be understood that the term nosing as used herein refers to the rounded edge of a finishing plate, which may have more than one such edge. For example in an open staircase or at the bottom or top stairs, nosings may extend at the leading and the side edges of the tread. The scope of the invention is thus to be construed accordingly.

The invention also includes a staircase including one or more finishing plate arrangements according to the primary aspect of the invention.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinabove described.

I claim:

1. A staircase finishing plate arrangement comprising a tread portion presenting a finishing surface layer, a nosing extending across substantially the whole length of the tread portion, a supporting layer affixed to the underside of the surface layer and mortised into the nosing, and mechanical securement means provided between the nosing and an underlying tread and riser and being oriented generally parallel to a plane of said tread portion to allow the plate arrangement to slidably secure to the underlying tread and riser in a direction generally parallel to said plane, the mechanical securement means being substantially hidden when the plate arrangement is secured to the underlying tread and riser.

2. A staircase finishing plate according to claim 1 wherein the finishing surface layer of the tread portion is unitary wherein the mechanical securement means are in the form of a plurality of fixtures freely pivotally mounted on a corresponding underlying tread about an axis generally perpendicular to the plane of the tread portion for penetrating and locating the tread portion in place in the area of the nosing.

3. A staircase finishing plate according to claim 1 wherein the support layer is of a greater thickness than the surface layer.

4. A staircase finishing plate according to claim 1 wherein the mortising of the supporting layer into the nosing includes tapering of the fore edge of that supporting layer to provide a feather-edge, the nosing has a correspondingly tapered groove, and wherein the feather-edge frictionally engages within the groove of the nosing.

5. A staircase finishing plate according to claim 1 wherein the support layer is bonded to the underside of the surface layer fully at their interengaging faces including the mortise.

6. A staircase finishing plate according to claim 1 wherein the pivotable fixtures comprise sector-shaped sharpened sprig-like fasteners securable within recesses formed in the top horizontal surface of a non-finished or worn tread.

7. A staircase finishing plate according to claim 6 wherein the sharpened ends of the sprig-like fasteners are bevelled on their undersides such as in use to provide a wedging action in a downward direction upon penetration into the nosing.

8. A staircase finishing plate according to claim 6 wherein the recesses are dimensioned in such manner as to limit the degree of pivot thereby in use to afford a control on the extent of lateral adjustment possible as between the tread portion and the underlying tread.

9. A staircase according to claim 1 wherein at least one replacement riser is provided to connect said at staircase finishing plate.

10. A staircase according to claim 9 wherein the staircase finishing plate is installed with said at least one replacement riser abutting in downward manner the tread portion of the finishing plate in the vicinity of a rear edge remote from the nosing.

* * * * *